United States Patent [19]

Travor et al.

[11] Patent Number: 5,011,097

[45] Date of Patent: Apr. 30, 1991

[54] VEHICLE STEERING DEVICE

[75] Inventors: Bruce W. Travor, Holland; Roger A. Holler, Warminster, both of Pa.

[73] Assignee: The United States of America as represented by the Secretary of the Navy, Washington, D.C.

[21] Appl. No.: 579,921

[22] Filed: Aug. 30, 1990

[51] Int. Cl.[5] ..... F41G 7/00

[52] U.S. Cl. ..... 244/3.21; 102/384; 102/385; 244/3.24

[58] Field of Search ..... 244/3.16, 3.21, 3.24–3.3; 102/382, 384, 385

[56] References Cited

U.S. PATENT DOCUMENTS 4,523,728 6/1985 Frazer ..... 244/3.29

*Primary Examiner*—Harold J. Tudor

*Attorney, Agent, or Firm*—James V. Tura; James B. Bechtel; Susan E. Verona

[57] ABSTRACT

A vehicle steering device is disclosed that can be joined to any air-dropped, free-falling component and steers that component directly down to a pre-determined location on the earth's surface. The device is comprised of an aerodynamically-shaped housing that is joined to the front of the component, and which carries orientation means in a nose portion, high-density gravity-reaction means, and steering fins rotatably joined thereto. After the combination is dropped, at a pre-determined altitude and airspeed, the orientation means causes it to assume the most efficient aerodynamic position and then the gravity-reaction means forces the nose, which is joined to and leads the component, to dive into the earth. The reaction means are connected to the fins and force a controlled and predictable descent.

8 Claims, 2 Drawing Sheets

VEHICLE STEERING DEVICE

STATEMENT OF GOVERNMENT INTEREST

The invention described herein may be manufactured and used by or for the Government of the United States of America for governmental purposes without the payment of any royalties thereon or therefore.

FIELD OF THE INVENTION

This invention relates to air-dropped devices. More particularly, this invention relates to air-dropped devices that use the pull of gravity to provide flight control and steering.

BACKGROUND OF THE INVENTION

It is most desirable to have the ability to dispense a store from an aircraft travelling at low altitude and high velocity and obtain an immediate, controlled landing thereof at a vertical angle and with high-speed impact. Such delivery is useful, for instance, when dropping certain objects over ice fields or into "open leads" in ice-covered waters. Many devices, due to aerodynamic forces, require release from high altitudes to obtain the required near-vertical impact angle and impact velocity. One example of such devices is shown in U.S. Pat. No. 1,189,382, entitled "Aerial Dart", to H. S. Peck. This device still leaves a lot to be desired since it is meant to be dropped, at a high altitude, in a near-vertical altitude from a rather slow-moving vehicle. It is much more desirable to be able to make the controlled, precision drop from an aircraft flying low and fast.

SUMMARY OF THE INVENTION

It is therefore an object of the present invention to provide a vehicle steering device that attaches to air-dropped components and acts to steer the combination onto a predetermined flight path.

It is another object of the present invention to provide a vehicle steering device for use on high-velocity and low-altitude, air-dropped components that quickly converts the horizontal velocity of the dropped combination into a downward direction.

It is still another object of the present invention to provide a vehicle steering device that acts on a joined component to cause the pull of gravity to insure sufficient force in the vertical direction to allow the combination to be deeply implanted, in for instance an ice-field, after impact.

These and other objects of the present invention are achieved by a vehicle steering device that is fixedly joined to the front end of a second component, such as a sonobuoy or other similar device, and then the combination is ejected into a free-fall by a low and fast flying aircraft. The device is in the shape of an elongated bullet-shaped housing with means at its aft end to attach to another component and with control wings extending from opposite sides thereof. Inside the front of the nose portion is a cavity filled with a predetermined amount of mercury and sealed off by a tilted, or slanted, disc-shaped wall. A heavy weight sits adjacent the wall and is attached, by a lever arm, to a control wing attachment that connects two individual control wings to a rack and pinion control section.

Figure 1:
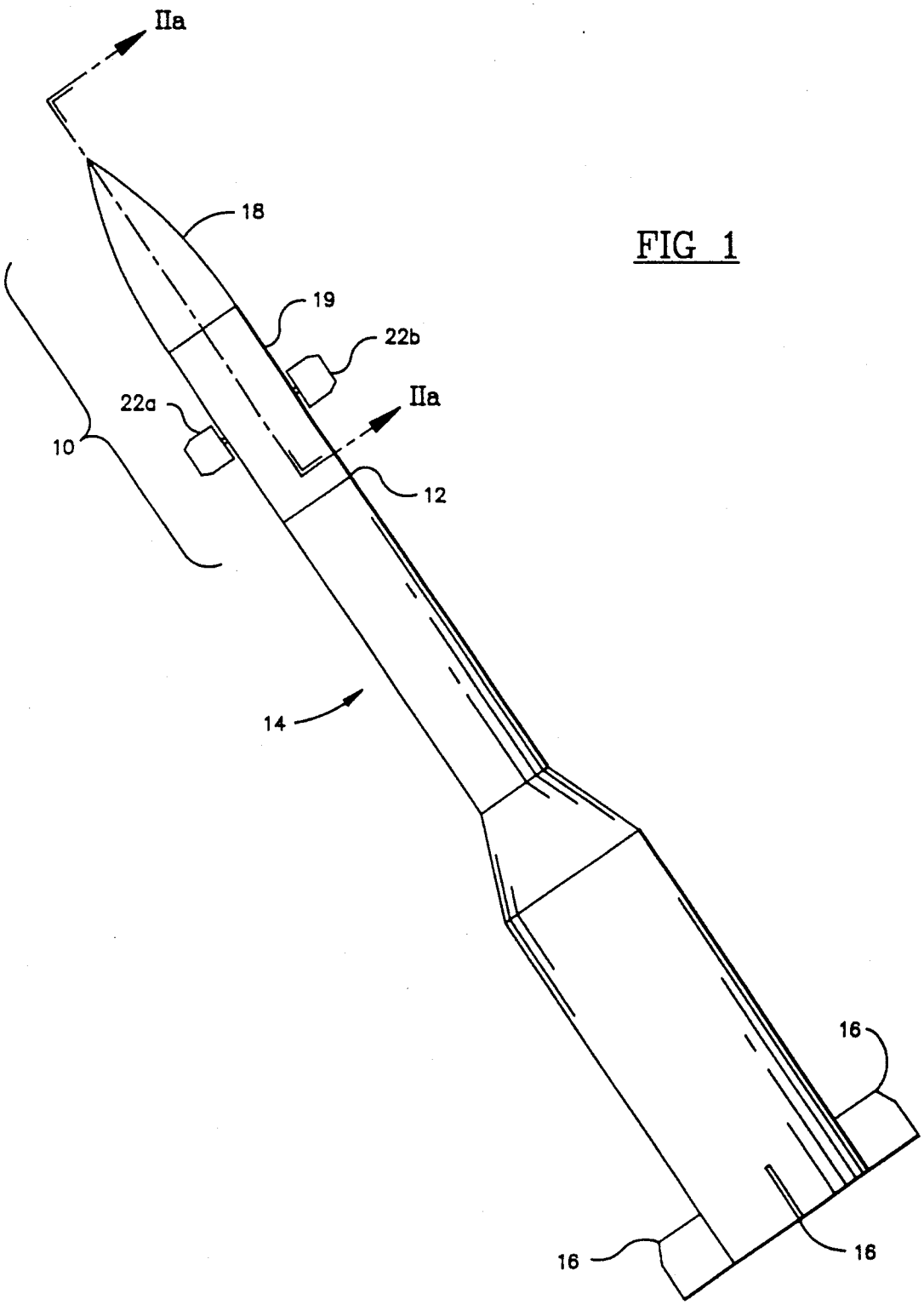
FIG. 1 shows a top elevational view of a vehicle steering device joined to a delivery component after the combination has been ejected from a vehicle.

FIG. *2a* shows a fragmentary cross-sectional view of the device as taken along lines IIa—IIa of FIG. 1;

FIG. *2b* shows a cross-sectional view of the device of FIG. 1 as taken along lines IIb—IIb of FIG. *2a;*

FIG. *3a* shows a fragmentary cross-sectional view of the device, similar to the view shown in FIG. *2a*, but after the combination has assumed a vertical dive position; and FIG. *3b* shows a fragmentary top elevational view of the device shown in FIG. *3a*.

DETAILED DESCRIPTION OF THE PREFERRED EMBODIMENTS

Figure 2A:
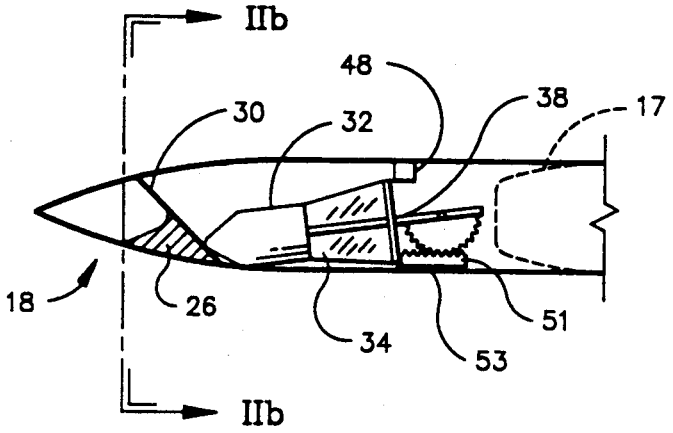
Figure 2B:
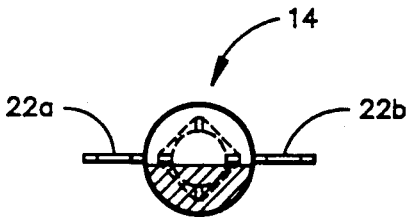

FIG. 1 shows a vehicle steering device 10, immediately after launch, attached as at 12 by means known in the industry to a component 14 that is to be air-dropped and delivered to a precise location without the assistance of internal locomotion. Component 14 may have a stability section, such as conical body 15 and aerodynamic fins 16, attached to its opposite end and could have a heavy penetrator such as 17 (shown in phantom in FIG. 2.). Device 10 has an ogive or conically-shaped nose portion 18, a tubular mid-section 19 and a pair of oppositely-extending wings, such as *22a, 22b,* rotatably attached thereto, as will be explained. Device 10 can be made, in suitable thickness, from molded ABS plastic or other rigid materials known in the art.

FIG. *2a,* a fragmentary cross-sectional view taken along lines II*a*—II*a* of FIG. 1, shows how the working, internal components have roll-stabilized the combination. FIG. *2b* is a cross-sectional view taken at the front of nose portion 18. A cavity 24, partially filled with a prespecified amount of mercury 26, or other similar material, is made inside of nose portion 18 between the tip end and a slanted, disc-shaped wall 30. Wall 30 is inserted inside nose portion 18 at a forward-leaning angle of approximately sixty degrees measured in a counterclock-wise direction from a hypothetical vertical line extending from its base. The radial orientation of wall 30 in relation to the other parts is important, as will be explained.

As shown in FIGS. *2a, 3a* and *3b,* weight 32, and its tail-cone 34 is fixedly attached by lever arm 38 to the top of semi-circular control gear 42. A rotatable, wing control rod 46 extends between wings *22a, 22b,* through suitable apertures in section 19, and is also fixedly attached to the top of gear 42. Weight 32 is made of a heavy, dense material, such as lead and can be any convenient shape, such as shown. The size of weight 32, tail-cone 34 and the length of arm 38 are all proportional to the amount of distance between, at one extreme, the placement of gear 42, and at the other end, the base section of wall 30. The preferred design allows weight 32 to rest, unencumbered, on the inside surface of section 19.

Attached to the inside surface of section 19, adjacent the rearward most edge of tail-cone 34, is a limit stop 48, in the form of a projection of sufficient size to prevent any movement of cone 34, and weight 32, as will be explained. A rack 51, slidable on rail 53 (which rail 53 is secured to the inside surface of section 19), intermeshes with the teeth of gear 42, as is shown. Tail cone 34 is preferably made of a strong, lightweight material, such as ABS plastic or aluminum, as are fins 22*a*, 22*b*. Lever arm 38 and rod 46 can be made from steel and gear 42 and rack 51 are made from similar materials known in the art.

OPERATION

As device 10 and component 14 are ejected into the free airstream, tail-end first, they will initially be traveling at or near the velocity of the transporting aircraft and in a rear horizontal position with respect to the ground below. The first object is to have the combination stabilize in such a flight attitude that weight 32 is free to pivot toward the earth, due to the effect of the gravitational force thereon, and this is accomplished by the design of cavity 24 and the movement of the mercury 26 therein in relation to the rotation axis for fins 22 around rod 46. Wall 30 is set inside nose portion 18 so that the plane formed thereby is parallel to an imaginary plane passing through rod 46. This placement and the continuous movement of mercury 26 as it rolls, or moves, around adjacent the concave inner walls of nose portion 18 have a self-orienting effect on the combination. Because mercury is such a heavy and nimble metal, the force of gravity will act on it to keep it moving to the lowest point inside cavity 24, even if device 10 is oriented, initially, upsidedown. When the combination is first ejected, inertia will force mercury 26 to "pile" up against wall 30. As quickly as it can though, mercury 26 will seek a lower point, eventually causing the combination to roll along its longitudinal axis to the position shown in FIG. 2*a*, where weight 32 is free to pivot as it forces the nose of the combination into a dive.

Figure 3A:
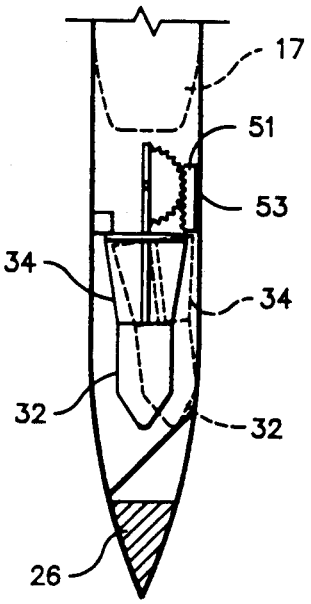
Figure 3B:
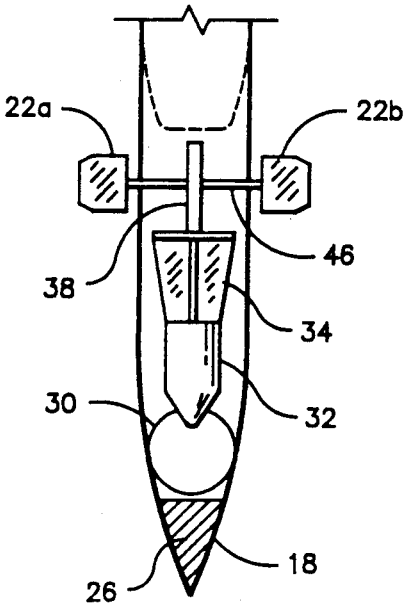

Now that weight 32 is free to pivot, it is displaced toward the center of the earth by the force of gravity. This accomplishes the second objective, i.e., to force the nose into a vertical, dive, position. Weight 32, reacting to the pull of gravity, moves fins 22, in a controlled manner (which thereby prevents any fin flutter) to "trim" the combination into a controlled dive. The dive will settle into a pure vertical flightpath and weight 32 cannot over-compensate due to the contact of tail-cone 34 against limit stop 48. As seen in FIG. 3*a*, mercury 26 is now in the tip end of cavity 24, the lowest possible point. Thus the invention re-orients component 14 for vertical entry and by so doing simultaneously causes the high drag area (the length of the component) to be exposed to the horizontal, therefore decreasing the horizontal velocity, and the low drag, streamlined area to be exposed to the vertical, therefore increasing the vertical velocity. Due to the pull of gravity, the vertical velocity then is increased, magnifying the pull of device 10 and penetrator 17 carried thereon.

Finally, while the vehicle steering device has been described with reference to a preferred embodiment, it should be understood that the embodiment is merely illustrative as there are numerous variations and modifications which may be made by those skilled in the art. Thus, the invention is to be construed as being limited only by the spirit and scope of the appended claims.

What we claim is:

1. A vehicle steering device, that is joined to an air-dropped component, comprising:

a. aerodynamic housing means, including a front tip end, to provide necessary structure to join to the component;

b. nose cavity means in said housing means carrying orientation means that causes the device to assume proper longitudinal orientation with respect to the earth's gravitational field;

c. gravity reaction means located inside said housing means adjacent said nose cavity to force the device to seek the earth's surface; and d. guiding means connected to said reaction means to adjust the flight path of the device during free-fall.

2. A vehicle steering device as described in claim 1 wherein said aerodynamic housing means has an ogive-shaped nose portion.

3. A vehicle steering device as described in claim 1 wherein said aerodynamic housing means has a conically-shaped nose portion.

4. A vehicle steering device as described in claim 1 wherein said nose cavity means has a rear wall, oppositely disposed from said tip end, that is slanted at a pre-specified angle toward said tip end, and carries a pre-specified amount of slidable means therein.

5. A vehicle steering device as described in claim 1 wherein said gravity reaction means comprises a pre-specified weight movably fixed aft of said nose cavity means.

6. A vehicle steering device as described in claim 5 wherein said guiding means comprises oppositely-disposed wings joined to a common rod connected through said housing means to said weight at a control means.

7. A vehicle steering device as described in claim 6 wherein said control means comprises a semi-circular toothed gear contactingly associated with a toothed and slidable rack.

8. A steering device, for steering an air-dropped component joined thereto, comprising:

a hollow bullet-shaped nose;

a tubular mid-section joined to said nose and to the component;

said nose containing a cavity defined by a wall slanted therein at a prespecified angle and containing a predetermined amount of mercury;

a rack, slidably fixed to a predetermined location on the inside surface of said mid-section;

a gear contactingly adjacent said rack;

a mass of predetermined weight adjacent said wall and rigidly connected to said gear;

a rod, extending through oppositely-disposed apertures in said mid-section and joined to said gear; and a pair of wings fixed to opposite ends of said rod.

* * * * *